US012691483B2

(12) United States Patent
Fujita et al.

(10) Patent No.: US 12,691,483 B2
(45) Date of Patent: Jul. 28, 2026

(54) COLD ROLLING MILL ROLLING CONDITION CALCULATION METHOD, COLD ROLLING MILL ROLLING CONDITION CALCULATION DEVICE, COLD ROLLING METHOD, COLD ROLLING MILL, AND STEEL SHEET MANUFACTURING METHOD

(71) Applicant: JFE Steel Corporation, Tokyo (JP)

(72) Inventors: Noriki Fujita, Tokyo (JP); Takuya Kitamura, Tokyo (JP); Tetsuya Arakawa, Tokyo (JP); Yoshiki Ikoma, Tokyo (JP); Miwa Ohashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 318 days.

(21) Appl. No.: 18/275,064

(22) PCT Filed: Oct. 29, 2021

(86) PCT No.: PCT/JP2021/040051

§ 371 (c)(1),
(2) Date: Jul. 31, 2023

(87) PCT Pub. No.: WO2022/172524

PCT Pub. Date: Aug. 18, 2022

(65) Prior Publication Data

US 2024/0091833 A1 Mar. 21, 2024

(30) Foreign Application Priority Data

Feb. 15, 2021 (JP) ..... 2021-021845

(51) Int. Cl.
*B21B 37/00* (2006.01)

(52) U.S. Cl.
CPC ..... *B21B 37/007* (2013.01)

(58) Field of Classification Search
CPC ..... B21B 1/28; B21B 1/36; B21B 37/007; B21B 37/46; B21B 38/008;
(Continued)

(56) References Cited

U.S. PATENT DOCUMENTS 3,787,667 A 1/1974 King et al.
2003/0078684 A1 4/2003 Martin et al.
(Continued)

FOREIGN PATENT DOCUMENTS

CN 101144144 A 3/2008
CN 105478490 A 4/2016
(Continued)

OTHER PUBLICATIONS

Translation JP 02-258107A, Hayakawa Oct. 1990.*
(Continued)

*Primary Examiner* — Edward T Tolan
(74) *Attorney, Agent, or Firm* — Buchanan Ingersoll & Rooney PC

(57) ABSTRACT

A cold rolling mill rolling condition calculation method includes: an estimation step of estimating a rolling constraint condition with respect to a target steady rolling condition of a roll target material, by inputting second multi-dimensional data to a prediction model, the prediction model having been trained with explanatory variable and response variable, the explanatory variable being first multi-dimensional data generated based on non-steady rolling performance data, among past rolling performance in rolling a roll material by a cold rolling mill, and the response variable being steady rolling performance data and rolling constraint condition data during steady rolling, and the second multi-dimensional data having been generated based on non-steady rolling performance data of the roll target material; and a change step of changing the target steady rolling condition so that the
(Continued)

estimated rolling constraint condition satisfies a predetermined condition.

6 Claims, 6 Drawing Sheets

(58) Field of Classification Search
CPC ..... B21B 2273/16; B21B 2275/06; B21B 2001/221; B21B 37/24; G05B 13/048
See application file for complete search history.

(56) References Cited

U.S. PATENT DOCUMENTS

| | | | |
|---|---|---|---|
| 2022/0126339 | A1 | 4/2022 | Yamazaki |
| 2022/0126342 | A1 | 4/2022 | Sugiyama et al. |

FOREIGN PATENT DOCUMENTS

| | | | | | |
|---|---|---|---|---|---|
| CN | 106345823 | A | | 1/2017 | |
| CN | 108311544 | A | | 7/2018 | |
| CN | 108326049 | A | | 7/2018 | |
| CN | 111587156 | A | | 8/2020 | |
| CN | 111889524 | A | | 11/2020 | |
| EP | 3 006 126 | A1 | | 4/2016 | |
| JP | 02-258107 | A | * | 10/1990 | ..... B21B 37/00 |
| JP | H09-323111 | A | | 12/1997 | |
| JP | 6705519 | B1 | | 6/2020 | |
| JP | 2020131248 | A | | 8/2020 | |
| JP | 2020157327 | A | | 10/2020 | |
| KR | 20190127627 | A | | 11/2019 | |
| TW | 201609283 | A | | 3/2016 | |
| WO | 2020171096 | A1 | | 8/2020 | |

OTHER PUBLICATIONS

Translation CN 111889524A, Tang et al. Nov. 2020.*
CN 111889524A, Tang et al. Nov. 2020.*
CN 110788138A, Bai et al. Feb. 2020.*
The Extended European Search Report for European Application No. 21 925 769.8, dated Apr. 26, 2024 (7 pages).
International Search Report and Written Opinion for International Application No. PCT/JP2021/040051, dated Dec. 28, 2021, 5 pages.
Taiwanese Search Report for Taiwanese Application No. 110141880, dated Feb. 15, 2022, with English translation, 4 pages.
Office Action (The First Office Action) issued Aug. 7, 2025, by the State Intellectual Property Office of People's Republic of China in corresponding Chinese Patent Application No. 202180092883.1 and an English translation with Concise explanation of relevance of the Office Action. (24 pages).

* cited by examiner

COLD ROLLING MILL ROLLING CONDITION CALCULATION METHOD, COLD ROLLING MILL ROLLING CONDITION CALCULATION DEVICE, COLD ROLLING METHOD, COLD ROLLING MILL, AND STEEL SHEET MANUFACTURING METHOD

CROSS REFERENCE TO RELATED APPLICATIONS

This is the U.S. National Phase application of PCT/JP2021/040051, filed Oct. 29, 2021, which claims priority to Japanese Patent Application No. 2021-021845, filed Feb. 15, 2021, the disclosures of these applications being incorporated herein by reference in their entireties for all purposes.

FIELD OF THE INVENTION

The present invention relates to a cold rolling mill rolling condition calculation method, a cold rolling mill rolling condition calculation device, a cold rolling method, a cold rolling mill, and a steel sheet manufacturing method.

BACKGROUND OF THE INVENTION

When rolling a steel sheet into a cold-rolled thin steel sheet, the rolling is typically performed with a stabilized sheet running property of the steel sheet by obtaining a good shape (or flatness) of the steel sheet while maintaining favorable sheet thickness accuracy in the longitudinal direction and the width direction of the steel sheet. Many of the control factors of the cold rolling mill are automatically controlled by an actuator mounted on the cold rolling mill, leading to a decreased opportunity for an operator to set the control factors of the cold rolling mill.

On the other hand, for the purpose of suppressing fuel consumption with reduced weight and the like, there is an increasing need for a thin hard material that achieves a thin gauge and high strength. During cold rolling of such a difficult-to-roll material with a high load, correction of roll deflection represented by roll gap, work roll bender, intermediate roll shift, and roll expansion by thermal crown of a cold rolling mill, including a rolling load (and an accompanying calculated forward slip ratio and torque) is often an operating condition reaching the specification limit of the cold rolling mill. In this case, the operator sets the pass schedule and the rolling speed so as not to exceed the facility constraint of the cold rolling mill.

In addition, depending on the process conditions of the pre-rolling step and changes in the facility state and the coolant state of the cold rolling mill, mill vibration in the vertical direction or the horizontal direction referred to as chattering due to insufficient lubrication or excessive lubrication occurs at a frequency of about 30 Hz to 200 Hz, and a phenomenon of periodic change in the sheet thickness of the steel sheet is likely to occur. In this case, the operator needs to set the rolling speed that would not impair the productivity while satisfying the facility constraint of the cold rolling mill.

For this reason, in recent years, the operating speed of the cold rolling mill and thus the productivity are likely to vary depending on the experience of the operator. In such a background, Patent Literature 1 proposes a method of performing learning of past operating conditions using a neural network and performing mill setup of a rolling mill using a result of the learning.

PATENT LITERATURE

Patent Literature 1: JP 6705519 B

SUMMARY OF THE INVENTION

However, even though the rolling mill has an optimum operating condition at the time of mill setup, an increase in the rolling speed during operation would change the operating condition due to reasons such as the lubricating state in the roll bite, the thermal expansion of the rolling roll, and a raised temperature in the steel sheet, making it difficult, in some case, to reach the rolling speed that can be achieved in the coil.

Aspects of the present invention have been made in view of the above problems, and an object thereof is to provide a cold rolling mill rolling condition calculation method and a cold rolling mill rolling condition calculation device capable of calculating rolling conditions that would not impair productivity while ensuring rolling stability even during the rolling of a difficult-to-roll material with a high load. Another object according to aspects of the present invention is to provide a cold rolling method and a cold rolling mill capable of stably rolling a difficult-to-roll material under a high load with high productivity. Still another object according to aspects of the present invention is to provide a steel sheet manufacturing method capable of manufacturing a steel sheet having desired product characteristics and mechanical characteristics with high yield.

To solve the problem and achieve the object, a cold rolling mill rolling condition calculation method according to aspects of the present invention includes: an estimation step of estimating a rolling constraint condition with respect to a target steady rolling condition of a roll target material, by inputting second multi-dimensional data to a prediction model, the prediction model having been trained with explanatory variable and response variable, the explanatory variable being first multi-dimensional data generated based on non-steady rolling performance data, among past rolling performance in rolling a roll material by a cold rolling mill, and the response variable being steady rolling performance data and rolling constraint condition data during steady rolling, and the second multi-dimensional data having been generated based on non-steady rolling performance data of the roll target material; and a change step of changing the target steady rolling condition so that the estimated rolling constraint condition satisfies a predetermined condition.

Moreover, in the cold rolling mill rolling condition calculation method according to aspects of the present invention, the roll material includes a welded portion where a preceding material and a succeeding material are welded to each other, and the non-steady rolling performance data is rolling performance data when the welded portion passes through an exit side of the cold rolling mill.

Moreover, in the cold rolling mill rolling condition calculation method according to aspects of the present invention, the steady rolling performance data includes data indicating a target rolling speed during steady rolling of a roll material rolled in the past, and the change step includes a step of changing the target rolling speed during steady rolling of the roll target material so that the estimated rolling constraint condition satisfies a predetermined condition.

Moreover, a cold rolling mill rolling condition calculation device according to aspects of the present invention includes: an estimation means that estimates a rolling constraint condition with respect to a target steady rolling condition of a roll target material, by inputting second multi-dimensional data to a prediction model, the prediction model having been trained with explanatory variable and response variable, the explanatory variable being first multi-dimensional data generated based on non-steady rolling performance data, among past rolling performance in rolling a roll material by a cold rolling mill, and the response variable being steady rolling performance data and rolling constraint condition data during steady rolling, and the second multi-dimensional data having been generated based on non-steady rolling performance data of the roll target material; and a change means that changes the target steady rolling condition so that the estimated rolling constraint condition satisfies a predetermined condition.

Moreover, a cold rolling method according to aspects of the present invention includes a step of rolling a roll target material using a target steady rolling condition changed using the cold rolling mill rolling condition calculation method according to aspects of the present invention.

Moreover, a cold rolling mill according to aspects of the present invention includes the cold rolling mill rolling condition calculation device according to aspects of the present invention.

Moreover, a steel sheet manufacturing method according to aspects of the present invention includes: a cold rolling step of cold rolling a roll material using the cold rolling method according to aspects of the present invention; and an annealing step of applying an annealing treatment at a soaking temperature of 600° C. to 950° C. and a furnace tension of 0.1 to 3.0 kgf/mm$^2$ on the roll material rolled by cold rolling in the cold rolling step.

According to the cold rolling mill rolling condition calculation method and the cold rolling mill rolling condition calculation device according to aspects of the present invention, it is possible to calculate rolling conditions that would not impair productivity while ensuring rolling stability even in the rolling of a difficult-to-roll material with a high load. Further, according to the cold rolling method and the cold rolling mill according to aspects of the present invention, it is possible to stably roll a difficult-to-roll material with a high load with high productivity. Still further, according to the steel sheet manufacturing method according to aspects of the present invention, it is possible to manufacture a steel sheet having desired product characteristics and mechanical characteristics with high yield.

DETAILED DESCRIPTION OF EMBODIMENTS OF THE INVENTION

Hereinafter, a cold rolling mill rolling condition calculation method, a cold rolling mill rolling condition calculation device, a cold rolling method, and a cold rolling mill according to an embodiment of the present invention will be described with reference to the drawings. Note that the following embodiments illustrate devices and methods for embodying the technical ideas of the present invention, and are not to specify the material, shape, structure, arrangement, and the like of the components to the following embodiments. The drawings are schematic illustrations. For this reason, it should be noted that the relationship, ratio, and the like between the thickness and the planar dimensions are different from actual measurements, and there are portions in which the relationship and ratio of the dimensions are different between the drawings.

[Configuration of Cold Rolling Mill]

First, a configuration of a cold rolling mill according to an embodiment of the present invention will be described with reference to FIG. 1. In the present description, "cold rolling" may be simply referred to as "rolling", and thus, "cold rolling" and "rolling" are synonymous in the present description. In the following description, a steel sheet will be described as an example of a roll material (roll target material) rolled by a cold rolling mill. However, the roll material is not limited to a steel sheet, and may be other metal strips such as an aluminum plate.

Figure 1:
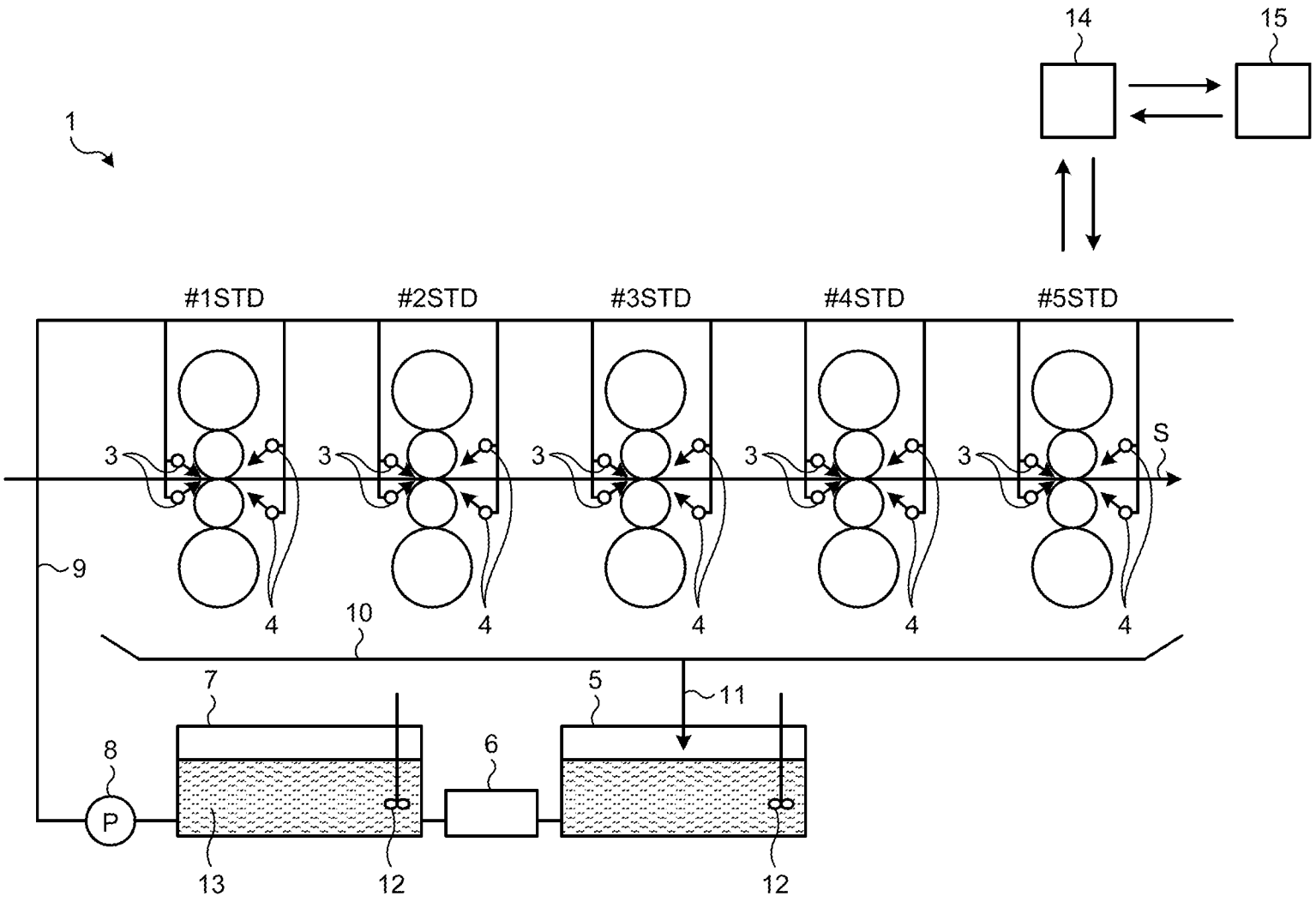
FIG. 1 is a schematic diagram illustrating a configuration of a cold rolling mill according to an embodiment of the present invention.

FIG. 1 is a schematic diagram illustrating a configuration of a cold rolling mill according to an embodiment of the present invention. As illustrated in FIG. 1, a cold rolling mill 1 according to an embodiment of the present invention is a tandem cold rolling mill provided with five rolling stands, namely, a first rolling stand to a fifth rolling stand (#1STD to #5STD) in order from an entry side (left side as viewed in the plane of drawing of FIG. 1) toward an exit side (right side as viewed in the plane of drawing of FIG. 1) of a steel sheet S. In the cold rolling mill 1, devices (not illustrated) such as a tension roll and a differential roll, a plate thickness meter, and a profilometer are appropriately installed between adjacent rolling stands. The configuration of the rolling stands, a conveyor of the steel sheet S, and the like are not particularly limited, and a known technique may be appropriately applied.

Each rolling stand of the cold rolling mill 1 is supplied with an emulsion rolling oil (in the following description, "emulsion rolling oil" may be simply referred to as "rolling oil") 13. The cold rolling mill 1 includes a dirty oil tank (recovery tank) 5 and a clean oil tank 7 as rolling oil storage tanks, and the rolling oil supplied from these rolling oil storage tanks is supplied to each rolling stand through a supply line 9.

The rolling oil recovered by an oil pan 10 disposed below the first to fifth rolling stands, that is, the rolling oil used in the cold rolling flows into the dirty oil tank 5 through a return pipe 11.

The rolling oil stored in the clean oil tank 7 is a rolling oil generated by mixing hot water (diluted water) and a stock solution of the rolling oil (to which a surfactant has been added). By adjusting the rotation speed of a stirring blade of a stirrer 12, that is, by adjusting the degree of stirring, the mixture of the hot water and the rolling oil stock solution is made into a rolling oil having a desired average particle diameter and concentration range.

The stock solution of the rolling oil may be a stock solution used in normal cold rolling, for example, it is possible to use a stock solution having any of natural oil, fatty acid ester, and hydrocarbon-based synthetic lubricating oil as a base oil. Furthermore, these rolling oils may include additives used for ordinary cold rolling oils such as oil improvers, extreme pressure additives, and antioxidants.

The surfactant added to the rolling oil may be either an ionic surfactant or a nonionic surfactant, and it is allowable to use a surfactant used in a normal circulation type coolant system (circulation type rolling oil supply system). The stock solution of the rolling oil is to be diluted to a concentration of preferably 2 to 8 mass % and more preferably 3 to 6.0 mass % to obtain O/W emulsion rolling oil in which oil is dispersed in water using a surfactant. The average particle diameter of the rolling oil is preferably 15 μm or less, and more preferably 3 to 10 μm.

After the start of the operation, the rolling oil recovered in the dirty oil tank 5 flows into the clean oil tank 7 via an iron powder remover 6 formed with a device such as an iron powder amount controller. The rolling oil recovered in the dirty oil tank 5 contains abrasion powder (iron powder) generated by friction between the rolling roll and the steel sheet S. Therefore, the iron powder remover 6 removes the abrasion powder so that the oil-soluble iron content of the recovered rolling oil will be an oil-soluble iron content acceptable as the rolling oil to be stored in the clean oil tank 7.

The movement of the emulsion rolling oil from the dirty oil tank 5 to the clean oil tank 7 via the iron powder remover 6 may be performed continuously or intermittently. The iron powder remover 6 may preferably be, but not limited to, a device that adsorbs and removes iron powder using a magnet filter such as an electromagnetic filter or a magnet separator. The iron powder remover 6 may be a known device using a method such as centrifugal separation.

Meanwhile, the rolling oil supplied to the rolling stand is partially taken out of the system by the steel sheet S or lost by evaporation. Therefore, the clean oil tank 7 has a configuration in which the stock solution of the rolling oil is appropriately fed (supplied) from a stock solution tank (not illustrated) so that the storage level and concentration of the rolling oil in the clean oil tank 7 are within predetermined ranges. In addition, hot water for diluting the rolling oil is also fed (supplied) to the clean oil tank 7 as appropriate. The storage level and concentration of the emulsion rolling oil in the clean oil tank 7 can be measured by a sensor (not illustrated).

Next, the rolling oil supply system in the cold rolling mill 1 will be described in detail. The rolling oil supply system in the cold rolling mill 1 includes the dirty oil tank 5, the iron powder remover 6, the clean oil tank 7, and a pump 8 that sucks the rolling oil from the clean oil tank 7. It is also allowable to dispose a foreign body removal strainer between the clean oil tank 7 and the pump 8.

The rolling oil supply system in the cold rolling mill 1 includes: a supply line 9 having one end connected to the clean oil tank 7; and five sets of lubricating coolant headers 3 and five sets of cooling coolant headers 4, which are branched at the other end (rolling mill side) of the supply line 9 and disposed at positions corresponding to the individual stands.

Each lubricating coolant header 3 is disposed on the entry side of the rolling stand, and injects rolling oil as lubricating oil from spray nozzles individually provided toward the roll bite to supply the lubricating oil to the roll bite and the work roll. The cooling coolant header 4 is disposed on the exit side of the rolling stand, and cools the rolling roll by injecting the rolling oil from individual spray nozzles to the rolling roll.

With such a configuration, the emulsion rolling oil in the clean oil tank 7 is pressure-fed to the supply line 9 by the pump 8, supplied to the lubricating coolant header 3 and the cooling coolant header 4 disposed in each rolling stand, and supplied to the injection site from the spray nozzles provided in each rolling stand. The emulsion rolling oil supplied to the rolling roll is recovered to the oil pan 10 except for the emulsion rolling oil taken out of the system by the steel sheet S or the emulsion rolling oil lost by evaporation, and is then returned to the dirty oil tank 5 through the return pipe 11. Thereafter, a part of the emulsion rolling oil stored in the dirty oil tank 5 is returned into the clean oil tank 7 after a certain amount of the oil-soluble iron content generated by the cold rolling has been removed using the iron powder remover 6.

By the rolling oil supply system described above, the rolling oil after abrasion content removal processing is supplied, in circulation, to the rolling roll. That is, the supplied emulsion rolling oil is used in circulation. Note that the clean oil tank 7 corresponds to a rolling oil tank for circulation in a conventional circulation oil supply system, and as described above, a stock solution of rolling oil is appropriately fed (supplied) to the clean oil tank 7.

[Steady Rolling Speed Prediction Model]

Next, a steady rolling speed prediction model according to an embodiment of the present invention will be described.

Functionalities related to the steady rolling speed prediction model which is an embodiment of the present invention are implemented by a rolling control device 14 and an arithmetic unit 15 illustrated in FIG. 1.

The rolling control device 14 controls rolling conditions of the cold rolling mill 1 based on a control signal from the arithmetic unit 15.

Figure 2:
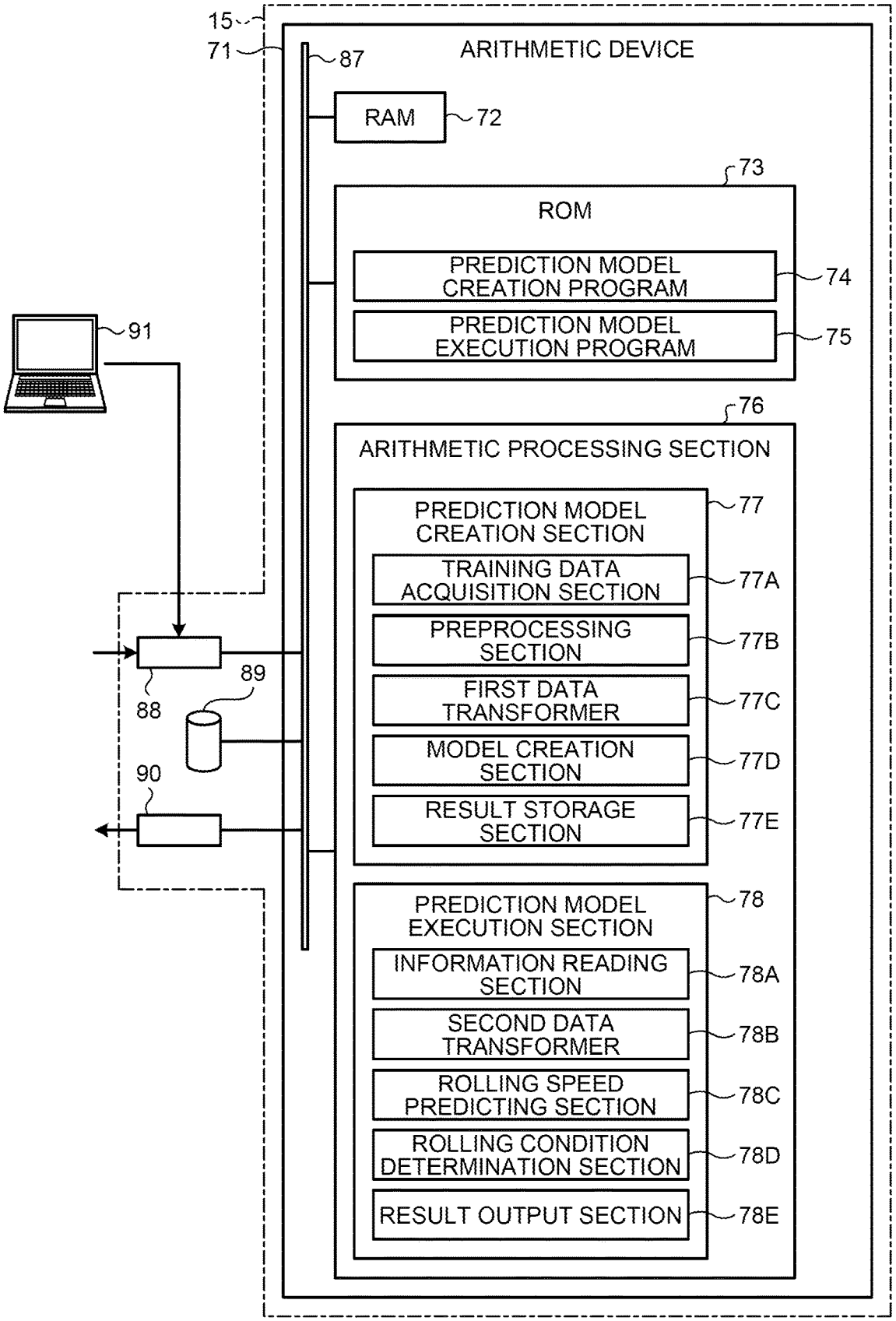
FIG. 2 is a block diagram illustrating a configuration of an arithmetic unit illustrated in FIG. 1.

FIG. 2 is a block diagram illustrating a configuration of the arithmetic unit 15 illustrated in FIG. 1. As illustrated in FIG. 2, the arithmetic unit 15 includes an arithmetic device 71, an input device 88, a storage device 89, and an output device 90.

The arithmetic device 71 is connected, in wired connection, to the input device 88, the storage device 89, and the output device 90 via a bus 87. However, connection among the arithmetic device 71, the input device 88, the storage device 89, and the output device 90 is not limited to this mode of connection, and may be connected wirelessly, or may be connected in a combination of wired and wireless connections.

The input device 88 functions as an input port that receives input of control information from the rolling control device 14 as well as information from an operation monitoring device 91. The information from the operation monitoring device 91 includes execution command information of a steady rolling speed prediction model, information regarding the steel sheet S being a roll target (Preprocessing conditions, type of steel, and size), and cold rolling condition information (numerical information, character information, and image information) set by a process computer or an operator before cold rolling.

The storage device 89 is a device that includes components such as a hard disk drive, a semiconductor drive, an optical drive, for example, and that stores information necessary for the present system (information necessary for implementation of the functionalities of a prediction model creation section 77 and a prediction model execution section 78 described below).

Examples of the information necessary for implementation of the functionalities of the prediction model creation section 77 include information indicating explanatory variables and response variables related to cold rolling (constraint determination with respect to the target rolling speed) such as required characteristics (type of steel, sheet thickness, sheet width, etc.) of the steel sheet S and mill facility constraints, rolling information after passage through a welding point of the steel sheet S, properties of the coolant used in a rolling stand, and a target rolling speed.

Examples of the information necessary for implementation of the functionalities of the prediction model execution section 78 include the steady rolling speed prediction model for each rolling state of the steel sheet S created by the prediction model creation section 77 and various types of information input to the steady rolling speed prediction model.

The output device 90 functions as an output port that outputs a control signal from the arithmetic device 71 to the rolling control device 14.

The operation monitoring device 91 includes any type of display such as a liquid crystal display or an organic display. The operation monitoring device 91 receives various types of information indicating operational states of the cold rolling mill 1 from the rolling control device 14, and displays the received information on an operation screen (operational screen) for the operator to monitor the operational state of the cold rolling mill 1.

The arithmetic device 71 includes RAM 72, ROM 73, and an arithmetic processing section 76.

The ROM 73 stores a prediction model creation program 74 and a prediction model execution program 75.

The arithmetic processing section 76 has an arithmetic processing function and is connected to the RAM 72 and the ROM 73 via a bus 87.

The RAM 72, the ROM 73, and the arithmetic processing section 76 are connected to the input device 88, the storage device 89, and the output device 90 via a bus 87.

The arithmetic processing section 76 includes a prediction model creation section 77 and a prediction model execution section 78 as functional blocks.

The prediction model creation section 77 is a processing section that creates a steady rolling speed prediction model by a machine learning method that links past rolling performances and rolling constraint conditions corresponding to the past rolling performances to each other in the cold rolling mill 1. In the present embodiment, a neural network model is used as a steady rolling speed prediction model to be created by the machine learning method. The machine learning method is not limited to the neural network, and other known machine learning methods may be adopted.

The prediction model creation section 77 includes a training data acquisition section 77A, a preprocessing section 77B, a first data transformer 77C, a model creation section 77D, and a result storage section 77E. When having received an instruction to create a steady rolling speed prediction model from the operation monitoring device 91, the prediction model creation section 77 executes the prediction model creation program 74 stored in the ROM 73, thereby functioning as the training data acquisition section 77A, the preprocessing section 77B, the first data transformer 77C, the model creation section 77D, and the result storage section 77E. The steady rolling speed prediction model is updated each time of execution by the prediction model creation section 77.

As the preprocessing for generating the steady rolling speed prediction model, the training data acquisition section 77A acquires a plurality of pieces of training data in which non-steady rolling performance data among the past rolling performance data is set as input performance data (explanatory variable), and the steady rolling performance data and the rolling constraint condition data at the time of steady rolling are set as output performance data (response variable). Specifically, the training data acquisition section 77A acquires a plurality of pieces of training data in which operation performance data of the rolling condition after passage through a welding point (rolling performance data when a welded portion where the preceding material and the succeeding material are welded to each other passes through the exit side of the cold rolling mill) and the target rolling speed are set as the input performance data, and the constraint determination value at the target rolling speed during the cold rolling using the input performance data is set as the output performance data. The training data acquisition section 77A acquires the input performance data and the output performance data from the storage device 89 to create training data. Each training data includes a set of input performance data and output performance data. The training data is stored in the storage device 89. The training data acquisition section 77A may supply the training data to the preprocessing section 77B or the model creation section 77D without storing the training data in the storage device 89.

The input performance data includes multi-dimensional array information in which explanatory variables are joined in the time direction. In the present embodiment, information as illustrated in FIGS. 3(*a*) to 3(*c*) is adopted as the multi-dimensional array information.

Figure 3:
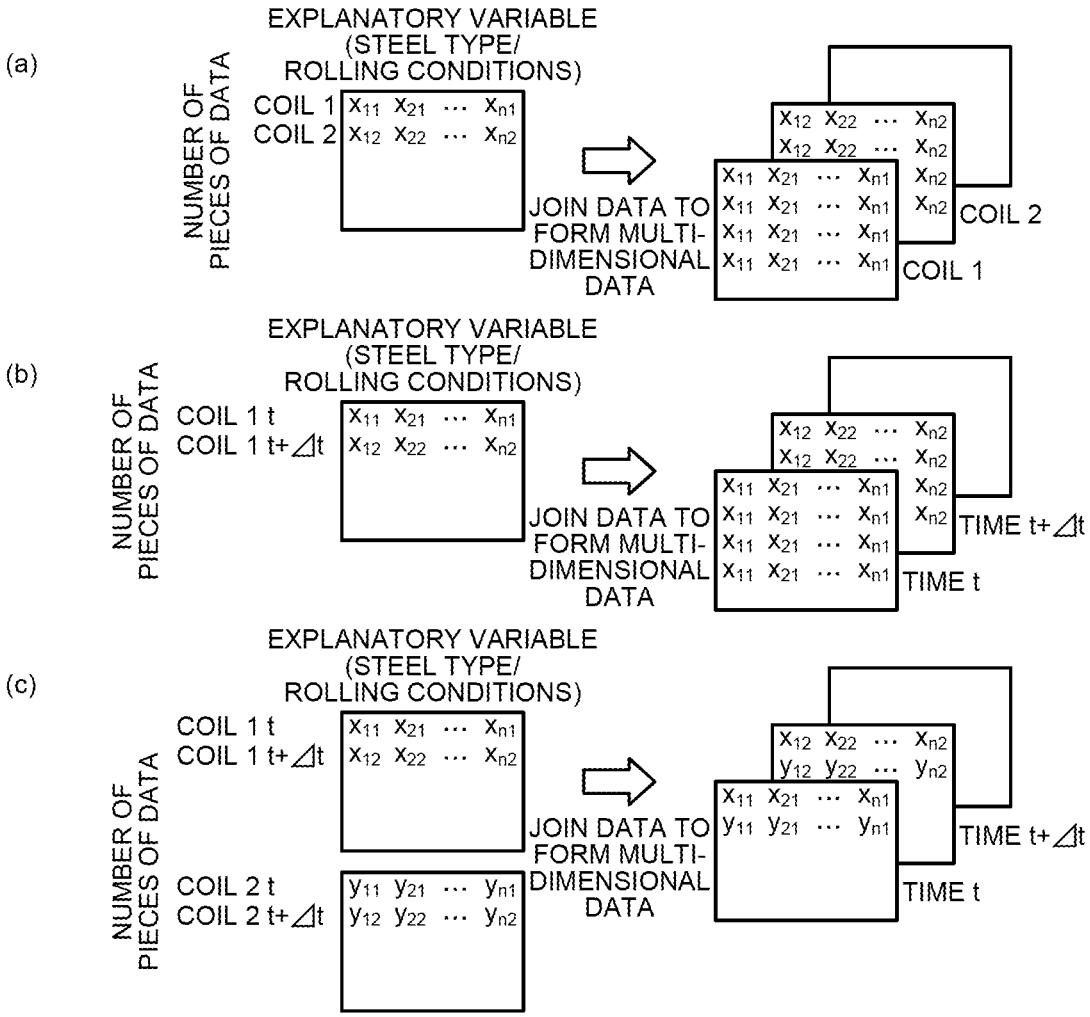
FIG. 3 is a diagram illustrating an example of multi-dimensional array information.

FIG. 3(*a*) illustrates an example of input performance data having its column (vertical direction) set as coil conditions and having its row (horizontal direction) set as explanatory variables selected from operating conditions of the cold rolling mill 1. The number of rows of the explanatory variables is not particularly limited. In the present embodiment, multi-dimensional array information joined in the time direction (depth direction) for each coil condition is created and set as input performance data. The time pitch at the time of joining in the time direction is not particularly limited. In a case where there is no time series data or in a case where the data is an explanatory variable that does not change with time, the time pitch is 0 second, and the same data is to be duplicated.

FIG. 3(*b*) illustrates an example of input performance data having its column (vertical direction) set as elapsed time after passage through a welding point of a coil and having its row (horizontal direction) set as explanatory variables selected from operating conditions of the cold rolling mill 1. Similarly to the example of FIG. 3(*a*), multi-dimensional array information joined in the time direction (depth direction) is created for each coil condition, and set as input performance data.

FIG. 3(*c*) illustrates an example of input performance data having its column (vertical direction) set as elapsed time after passage through a welding point of a coil and having its row (horizontal direction) set as explanatory variables selected from operating conditions of the cold rolling mill 1. The input performance data does not need to be data regarding the same coil as long as it is joined in the time direction (depth direction), and in the present example, multi-dimensional array information obtained by joining time-series operation information of a plurality of coils is created and set as the input performance data.

When past rolling performance data is not stored in the storage device 89 (for example, in the case of rolling conditions or steel type conditions having no past performance) or when the sample volume is small, the training data acquisition section 77A requests the operator to execute cold rolling one or a plurality of times without using the steady rolling speed prediction model. In addition, the more the number of pieces of training data stored in the storage device 89, the higher the prediction accuracy to be achieved by the steady rolling speed prediction model. Therefore, when the number of training data is less than a preset threshold, the training data acquisition section 77A may request the operator to execute cold rolling without using the steady rolling speed prediction model until the number of pieces of data reaches the threshold.

The preprocessing section 77B processes the training data acquired by the training data acquisition section 77A to be adapted for creation of the steady rolling speed prediction model. Specifically, the preprocessing section 77B standardizes (normalizes) the value range of the input performance data between 0 to 1 as necessary in order to allow the rolling performance data constituting the training data to be loaded to the neural network model.

The input performance data is multi-dimensional information. Therefore, the first data transformer 77C performs dimensionality reduction on the input performance data in a state where features are retained using a convolutional neural network 300 to transform the data into one-dimensional information (refer to FIG. 4). The input performance data is connected to an input layer 101 illustrated in FIG. 4 as one-dimensional information.

Figure 5:
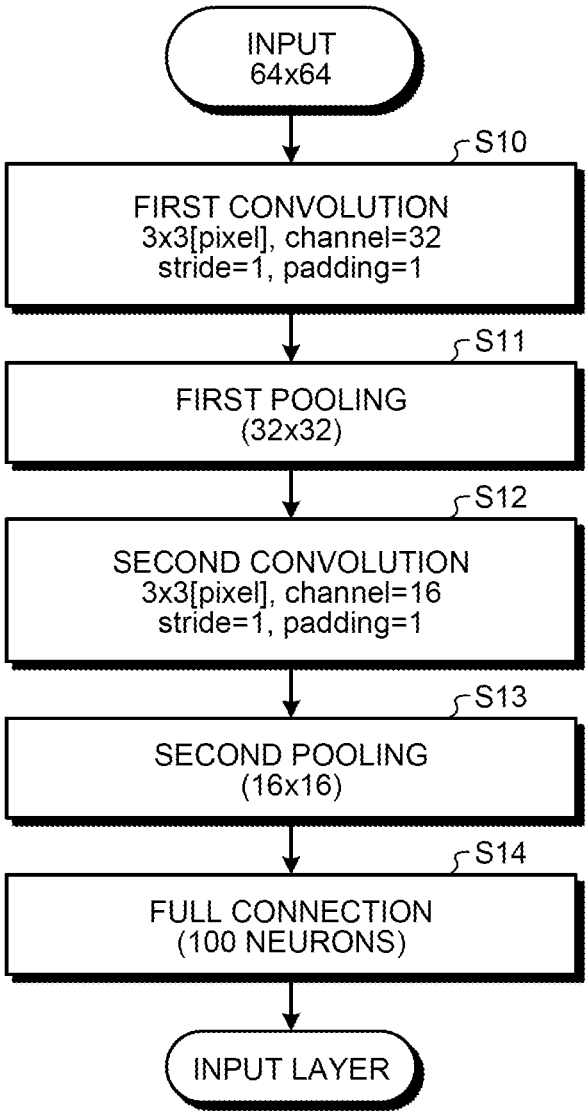
FIG. 5 is a flowchart illustrating a flow of processing of converting multi-dimensional array information into one-dimensional information.

Here, a processing example of the first data transformer 77C will be described with reference to FIG. 5. FIG. 5 is a flowchart illustrating a flow of processing of converting multi-dimensional array information into one-dimensional information. As illustrated in FIG. 5, the processing of transforming the multi-dimensional array information into the one-dimensional information, that is, the method of storing the multi-dimensional array information uses a structure in which inputs and outputs of a plurality of filters are connected in multiple stages. That is, the processing of transforming the multi-dimensional array information into the one-dimensional information includes, in order from the input side, a first convolution step S10, a first pooling step S11, a second convolution step S12, a second pooling step S13, and a full connection step S14.

In the first convolution step S10, the first data transformer 77C uses multi-dimensional array information of a row×column pattern of 64×64 as input, and outputs a first feature map of a pattern of 64×64 by convolution operation. The first feature map indicates where and what type of local features are present in the input array. In the convolution operation, for example, a filter of a row×column pattern of 3×3 pixels and 32 channels is used, an application interval of the filter is set to 1, and a length of filling (padding) the periphery with 0 is set to 1.

In the first pooling step S11, the first data transformer 77C uses the first feature map output in the first convolution step S10 as an input, and sets the maximum value of the first feature map within a row×column pattern of 3×3 pixels as a new one pixel. The first data transformer 77C performs such an operation over the entire map while shifting pixels. With this operation, in the first pooling step S11, the first data transformer 77C outputs a second feature map obtained by compressing the first feature map.

In the second convolution step S12, the first data transformer 77C uses the second feature map as input, and outputs a third feature map by convolution operation. In the convolution operation, for example, a filter of a row×column pattern of 3×3 pixels and 16 channels is used, an application interval of the filter is set to 1, and a length of filling (padding) the periphery with 0 is set to 1.

In the second pooling step S13, the first data transformer 77C uses the third feature map output in the second convolution step S12 as an input, and sets the maximum value of the third feature map within a row×column pattern of 3×3 pixels as a new one pixel. The first data transformer 77C performs such an operation over the entire map while shifting pixels. With this operation, in the second pooling step S13, the first data transformer 77C outputs a fourth feature map obtained by compressing the third feature map.

In the full connection step S14, the first data transformer 77C lines up the information of the fourth feature map output in the second pooling step S13. Subsequently, 100 neurons output from the full connection step S14 make the input layer 101. Note that the convolution method and the number of output neurons are not limited to those described above. Furthermore, the method of the convolutional neural network may be implemented by using a known model such as GoogleNet, VGG 16, MOBILENET, or EFFICIENTNET.

The model creation section 77D generates a steady rolling speed prediction model including the non-steady rolling performance data as the input performance data and having the rolling constraint determination value at the target rolling speed as the output performance data by machine learning (including the information transformed by the first data transformer 77C) using the plurality of pieces of training data acquired by the preprocessing section 77B.

The present embodiment adopts a neural network as a machine learning method, and accordingly, the model creation section 77D creates a neural network model as the steady rolling speed prediction model. That is, the model creation section 77D generates a neural network model as a steady rolling speed prediction model that links the input performance data (rolling performance data including the target rolling speed) and the output performance data (rolling constraint determination value at the target rolling speed) to each other in the training data processed for generating the steady rolling speed prediction model. The neural network model is expressed by a functional formula, for example.

Specifically, the model creation section 77D performs setting of hyperparameters to be used for the neural network model, and performs learning with the neural network model using the hyperparameters. As an optimization calculation of the hyperparameter, the model creation section 77D first creates a neural network model in which some of the hyperparameters have been changed in stages for the training data, and selects the hyperparameter capable of achieving the highest prediction accuracy for the verification data.

Items usually set as the hyperparameter include, but not limited to, the number of hidden layers, the number of neurons in each hidden layer, the dropout rate in each hidden layer (blocking the transmission of neurons with a certain probability), the activation function in each hidden layer, and the number of outputs. In addition, examples of the hyperparameter optimization method can include, but not particularly limited to, a grid search of changing parameters in stages, a random search of randomly selecting parameters, or Bayesian optimization search.

Although the model creation section 77D is incorporated as a part of the arithmetic device 71, the configuration is not limited thereto. For example, a steady rolling speed prediction model may be created and stored in advance, and they may be read as appropriate.

Figure 4:
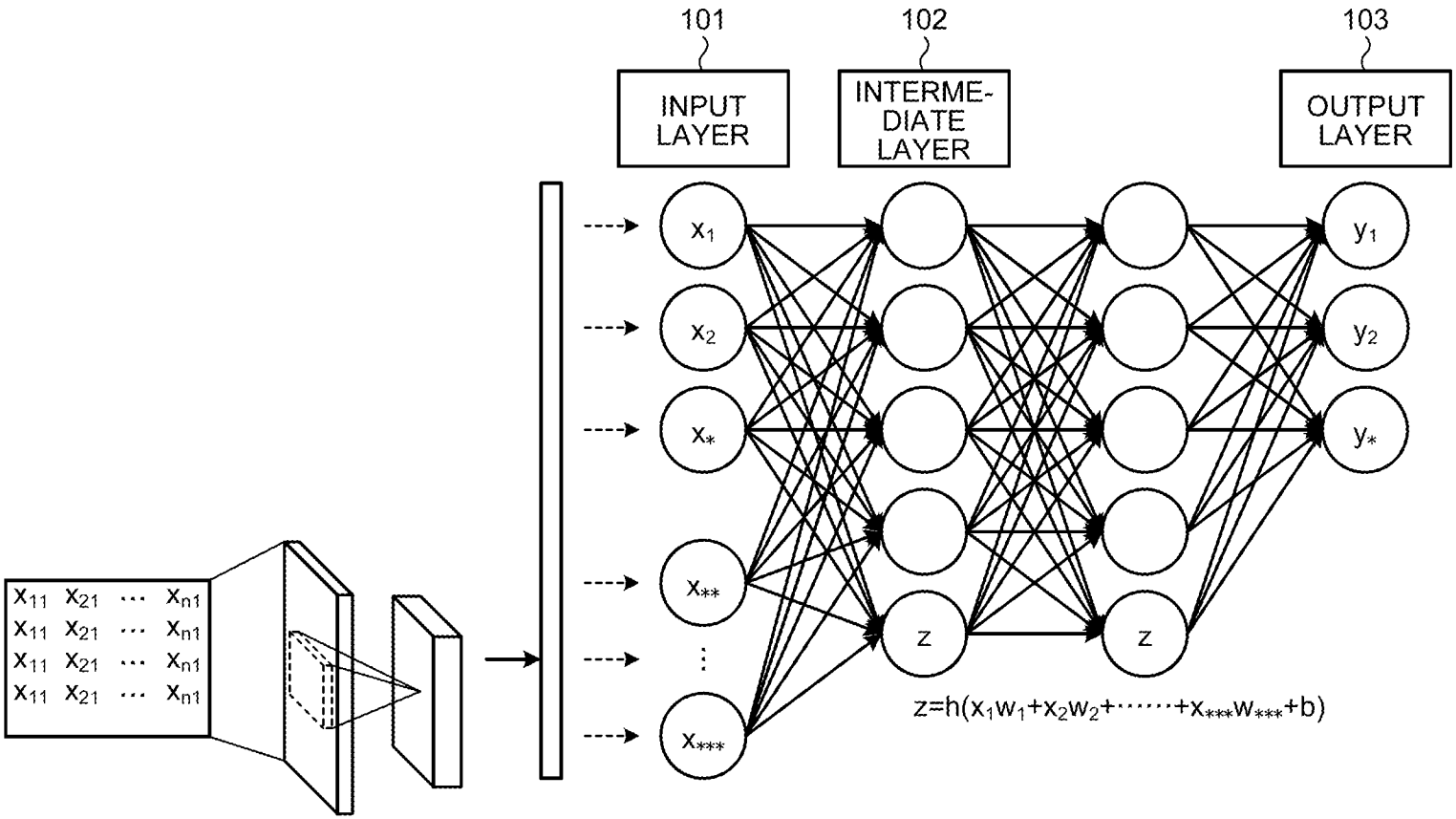
FIG. 4 is a diagram illustrating a configuration example of a steady rolling speed prediction model.

As illustrated in FIG. 4, the neural network model as the steady rolling speed prediction model in the present embodiment includes an input layer 101, an intermediate layer 102, and an output layer 103 in order from the input side.

The multi-dimensional array information created in FIG. 3 undergoes dimensionality reduction by the training data acquisition section 77A in a state where the features are retained using the convolutional neural network, and is stored in the input layer 101 in a state of being transformed into one-dimensional information.

The intermediate layer 102 includes a plurality of hidden layers, and each of the hidden layers includes a plurality of neurons. The number of hidden layers formed in the intermediate layer 102 and the number of neurons arranged in each hidden layer are not particularly limited. In the intermediate layer 102, transmission of a neuron from a certain neuron to a subsequent hidden layer is performed via an activation function together with weighting of a variable by a weighting factor. As the activation function, a Sigmoid function, a hyperbolic tangent function, or a ramp function can be used.

In the output layer 103, information of neurons transmitted by the intermediate layer 102 is combined and the result is output as a constraint determination value for a final target rolling speed. The number of outputs to be formed in the output layer 103 is not particularly limited. Learning is performed by gradually optimizing the weighting factor in the neural network model based on the output result, the past steady rolling performance at the time of cold rolling of the steel sheet S, and the rolling constraint performance at that time (including rolling load determination, rolling power determination, forward slip ratio determination, chattering determination, sheet shape determination, edge cracking determination, and sheet thickness accuracy determination).

After the weighting factor of the neural network model has been learned, the model creation section 77D inputs evaluation data (rolling condition performance of the steel sheet S being a roll target using the steady rolling speed prediction model) to the neural network model that has learned the weighting factor, and obtains an estimation result for the evaluation data.

Returning to FIG. 2. The result storage section 77E stores, in the storage device 89, the training data, the evaluation data, the parameter (weighting factor) of the neural network model, the output result of the neural network model for the training data, and the output result of the neural network model for the evaluation data.

During the cold rolling of the steel sheet S, the prediction model execution section 78 predicts the steady rolling speed of the steel sheet S during the cold rolling corresponding to the rolling condition of the steel sheet S being a roll target using the steady rolling speed prediction model created by the prediction model creation section 77. The prediction model execution section 78 then determines the steady rolling speed of the steel sheet S being a roll target.

In order to perform the above processing, the prediction model execution section 78 includes an information reading section 78A, a second data transformer 78B, a rolling speed predicting section 78C, a rolling condition determination section 78D, and a result output section 78E. Here, when having received a signal notifying that cold rolling is performed from the rolling control device 14 via the input device 88, the prediction model execution section 78 executes the prediction model execution program 75 stored in the ROM 73, thereby functioning as the information reading section 78A, the rolling speed predicting section 78C, the rolling condition determination section 78D, and the result output section 78E.

The information reading section 78A reads the rolling conditions of the steel sheet S being a roll target set by a process computer and an operator in the operation monitoring device 91 from the storage device 89.

The second data transformer 78B performs convolution processing of transforming the multi-dimensional array information, which will be input data to the steady rolling speed prediction model, into one-dimensional information. Since the processing of the second data transformer 78B is the same as the processing of the first data transformer 77C, detailed description of the processing will be omitted. The first data transformer 77C and the second data transformer 78B may be set as subroutine as one processing section.

The rolling speed predicting section 78C inputs one-dimensional information after convolution performed by the second data transformer 78B into the steady rolling speed prediction model to predict the steady rolling speed of the steel sheet S being a roll target. In addition, the rolling speed predicting section 78C predicts a constraint determination value with respect to the target rolling speed of the steel sheet S being a roll target.

The rolling condition determination section 78D performs processing of changing the setting of the target rolling speed and repeatedly returning to the execution of the above-described processing of the information reading section 78A, the second data transformer 78B, and the rolling speed predicting section 78C until the constraint determination value for the target rolling speed becomes equal to or less than a preset threshold.

The result output section 78E is activated when the constraint determination value for the target rolling speed becomes equal to or less than a preset threshold, and outputs the determined rolling condition (target rolling speed) of the steel sheet S being a roll target.

Next, processing of the prediction model execution section 78 will be described with reference to FIG. 6.

Figure 6:
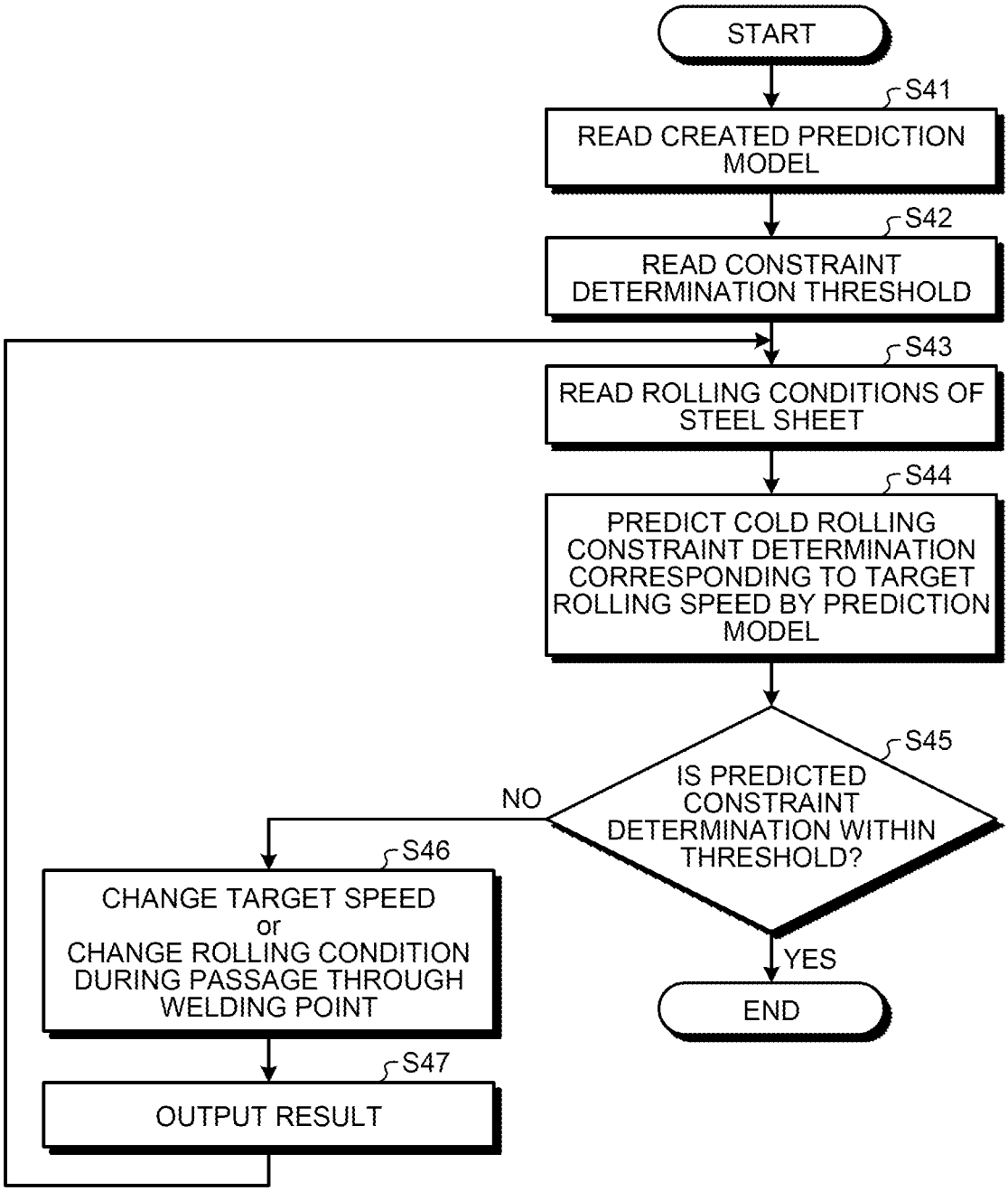
FIG. 6 is a flowchart illustrating a flow of processing performed by a prediction model execution section.

FIG. 6 is a flowchart illustrating a flow of processing of the prediction model execution section 78. As illustrated in FIG. 6, as a first step in execution of the steady rolling speed prediction model, the information reading section 78A of the prediction model execution section 78 reads, in the processing of step S41, a neural network model as a steady rolling speed prediction model corresponding to the required characteristics of the steel sheet S being a roll target from the storage device 89.

Next, in the processing of step S42, the information reading section 78A reads a required constraint determination threshold stored in the storage device 89 from the host computer via the input device 88. Next, the information reading section 78A reads, in the processing of step S43, the rolling conditions of the steel sheet S being a roll target stored in the storage device 89 from a host computer via the input device 88.

Next, in the processing of step S44, the rolling speed predicting section 78C of the prediction model execution section 78 obtains a constraint determination value with respect to the target rolling speed of the corresponding steel sheet S undergoing cold rolling by setting, as the input performance data, the data in which the rolling conditions of the steel sheet S being a roll target read in the processing of step S43 are put in multi-dimensional array, by using the neural network model as the steady rolling speed prediction model read in the processing of step S41. Note that the result of prediction performed by the neural network model is output to the output layer 103.

Next, the rolling condition determination section 78D of the prediction model execution section 78 determines, in the processing of step S45, whether the constraint determination value of the steel sheet S with respect to the target rolling speed obtained in the processing of step S44 is within the constraint determination threshold read in the processing of step S42. Note that, when the calculation has not been sufficiently converged, an upper limit may be set to the number of iterations of convergence within a range of calculation time that can be actually executed in the processing of step S45. Note that the fact that the constraint determination value is within the constraint determination threshold corresponds to satisfaction of a predetermined condition in accordance with aspects of the present invention.

When it is determined that the constraint determination value is within the constraint determination threshold (when the determination result in step S45 is YES), the prediction model execution section 78 ends the processing. In contrast, when it is determined that the constraint determination value is not within the constraint determination threshold (when the determination result in step S45 is No), the prediction model execution section 78 proceeds to the processing of step S46.

In the processing of step S46, the rolling condition determination section 78D changes a part of the rolling conditions (target rolling speed) of the steel sheet S being a roll target read in the processing of step S43, and proceeds to the processing of step S47. In the processing of step S47, the result output section 78E of the prediction model execution section 78 transmits information regarding a part of the rolling conditions determined to the rolling control device 14 via the output device 90.

When a part of the rolling conditions has been changed in the processing of step S46, the rolling condition determination section 78D determines, in the processing of step S47, a part of the rolling conditions, specifically, the rolling conditions of the steel sheet S being a roll target having a change in the target rolling speed, the rolling pass schedule, and the manipulated variable of the unit tension between the rolling stands, as the optimized rolling condition of the steel sheet S. Then, the rolling condition determination section 78D determines the manipulated variable of the rolling speed based on the rolling condition at that time. The rolling control device 14 changes the rolling conditions based on the information regarding the rolling speed transmitted from the result output section 78E in the cold rolling stage.

As a method of calculating the change amount of the rolling condition after passage through the welding point, the rolling condition determination section 78D calculates an appropriate rolling condition of the steel sheet S being a roll target based on a difference between the constraint determination value for the target rolling speed obtained in the processing of step S44 and the constraint determination threshold read in the processing of step S42. The rolling condition determination section 78D then compares the calculated rolling condition with the rolling condition of the steel sheet S being a roll target read in the processing of step S43, and changes the rolling condition in the processing of step S47.

Returning to the processing of step S43, the rolling speed predicting section 78C reads the rolling conditions of the steel sheet S being a roll target in which a part of the rolling conditions has been changed. In addition, in the processing of step S44, the rolling speed predicting section 78C obtains a constraint determination value with respect to the target rolling speed of the steel sheet S undergoing cold rolling corresponding to the rolling condition of the steel sheet S being a roll target read in the processing of step S43 by the neural network model as the steady rolling speed prediction model. In the processing of step S45, the rolling condition determination section 78D determines whether the constraint determination value obtained in the processing of step S44 is within the constraint determination threshold read in the processing of step S42. Thereafter, a series of processing of step S43, step S44, step S45, step S46, and step S47 is repeatedly executed until the determination result indicates YES. This ends the processing (rolling speed control determination step) performed by the prediction model execution section 78.

As is clear from the above description, the present embodiment uses a configuration in which the prediction model creation section 77 generates a steady rolling speed prediction model by a machine learning method that links past rolling performance of the steel sheet S and past steady rolling performance corresponding to the past rolling performance to each other. In addition, the prediction model execution section 78 obtains a constraint determination value with respect to the target rolling speed of the steel sheet S being a roll target by the created steady rolling speed prediction model during the cold rolling of the steel sheet S. The prediction model execution section 78 then determines the rolling condition after passage through the welding point of the steel sheet S being a roll target so as to set the obtained constraint determination value to a value within a threshold. This makes it possible to predict a steady rolling speed satisfying various constraints in the rolling operation independent of operator's experience and subjectivity, making it possible to maintain productivity while preventing troubles such as sheet thickness variation and breakage during cold rolling. Furthermore, according to the present embodiment, the numerical information collected from the rolling performance data is joined and the multi-dimensional array information is used as the input data as the explanatory variable used for the steady rolling speed prediction of the steel sheet S during the cold rolling, making it possible to identify, on the neural network model, the constraint occurring during the cold rolling and the factor highly contributing to the achievement of the maximum steady rolling speed.

A steel sheet having a final sheet thickness obtained by cold rolling is subjected to an annealing treatment in order to adjust mechanical characteristics and product characteristics. The annealing treatment is preferably performed in a horizontal furnace, the soaking temperature is preferably 600° C. to 950° C., and the in-furnace tension is preferably 0.1 to 3.0 kgf/mm$^2$. With the conditions of the soaking temperature less than 600° C. or the in-furnace tension less than 0.1 kgf/mm$^2$, it would not be possible to achieve sufficient shape correction effects during annealing in addition to a failure in achieving sufficient recrystallization or good magnetic characteristics. On the other hand, with the conditions of the soaking temperature exceeding 950° C. or the furnace tension exceeding 3.0 kgf/mm$^2$, the crystal grain size would be coarsened to decrease the mechanical strength of the steel sheet, or strain would remain in the steel sheet due to the application of tension to deteriorate the product characteristics.

Modifications

Although the embodiments of the present invention have been described above, the present invention is not limited thereto, and various modifications and improvements can be made. For example, in the present embodiment, modifications are allowable not only in the target rolling speed but also in a part of the rolling conditions (roll gap, tension between rolling stands, roll shift amount, and roll bender amount in each rolling stand of tandem rolling mill) at the time of passage through the welding point as the rolling conditions of the steel sheet S being a roll target read in the processing of step S43. In the present embodiment, the repetition of the steady rolling speed prediction of the steel sheet S by the steady rolling speed prediction model and the determination of the rolling condition are to be performed through the initial non-steady rolling stage to the final non-steady rolling stage, but may be performed in a part of the stages. The cold rolling mill 1 is not limited to the four-stage rolling mill, but may be a multi-stage rolling mill such as a two-stage (2Hi) rolling mill or a six-stage (6Hi) rolling mill, and the number of rolling stands is not particularly limited. Furthermore, the rolling mill may be a cluster rolling mill or a Sendzimir rolling mill.

In addition, when the arithmetic unit 15 calculates an abnormal controlled variable exceeding the change upper and lower limit values of the rolling speed or cannot calculate the controlled variable, the rolling control device 14 cannot execute control based on the command from the arithmetic unit 15. Therefore, it is preferable that the rolling control device 14 is not to perform the present implementation when the controlled variable from the arithmetic unit 15 is determined to be abnormal, when the controlled variable is not supplied from the arithmetic unit 15, or the like.

In addition, although the output device 90 and the operation monitoring device 91 are not connected in the configuration example illustrated in FIG. 2, the devices may be communicably connected to each other. With this configuration, the processing result of the prediction model execution section 78 (in particular, the steady rolling speed prediction information of the steel sheet S being rolled by the rolling speed predicting section 78C and the changed rolling conditions determined by the rolling condition determination section 78D) can be displayed on the operation screen of the operation monitoring device 91.

Implementation Example

Hereinafter, aspects of the present invention will be described based on an implementation example.

Using a tandem cold rolling mill including all five rolling stands according to the embodiment illustrated in FIG. 1, an experiment was conducted in which a raw steel sheet for an electromagnetic steel sheet containing 2.5 mass % Si with a base material thickness of 2.0 mm and a sheet width of 1000 mm was rolled with cold rolling into a roll material with a finished thickness of 0.300 mm. Stock solution used for the rolling oil was a stock solution obtained by adding 1 mass % of an oil-based agent and 1 mass % of an antioxidant to a base oil obtained by adding vegetable oil to synthetic ester oil, with additional 3 mass %, as concentration with respect to the oil, of a nonionic surfactant as a surfactant to the base oil. The emulsion rolling oil to be used in circulation was prepared into an emulsion rolling oil having a rolling oil concentration of 3.5 mass %, an average particle diameter of 5 μm, and a temperature of 55° C. As preliminary training, a training using a neural network model was performed using training data (past rolling performance data of about 3000 steel sheets), and then, a neural network model to be used for prediction of a steady rolling speed was created by linking past non-steady rolling performance of the steel sheet and the past steady rolling performance of the steel sheet to each other.

The past rolling performance data of the steel sheet used in accordance with aspects of the invention example was information including the base material thickness of the steel sheet, the crown of the base material, the deformation resistance, the sheet thickness, the rolling pass schedule (rolling load, tension, steel sheet shape, sheet thickness accuracy) at the time of passage through the welding point, the emulsion property, the work roll dimension, crown, and roughness information, the bender amount, and the work roll shift amount. In addition, multi-dimensional array information obtained by joining the rolling performance data in the time direction was used as the input performance data. As the past steady rolling performance data of the steel sheet, the determination performance of the steady rolling speed and the operating conditions (rolling load, torque, forward slip ratio, chattering, sheet thickness accuracy, and steel sheet shape) being constraints at that time were used for the learning. The roll gap was adjusted by a tandem cold rolling mill, and the steady rolling speed and the constraint determination value of the steel sheet after cold rolling were predicted by the created neural network model at the stage when the rolling control device 14 was turned on after passage through the welding point of the steel sheet. The rolling conditions were appropriately changed so that the predicted constraint determination value was set to a predetermined threshold or less, and the rolling conditions after the passage through the welding point were set.

Also in a comparative example, similarly to the invention example, an experiment was conducted in which a raw steel sheet (roll target) for an electromagnetic steel sheet containing 2.8 mass % Si with a base material thickness of 2.0 mm and a sheet width of 1000 mm was rolled with cold rolling to a sheet thickness of 0.3 mm. In the comparative examples under the conditions 1, 4, 7, 10, and 13, a neural network model used for chattering prediction was created by joining the past chattering performance data pieces using the input data in which the past rolling performance data pieces of the steel sheet were arranged in a one-dimensional array without being joined in the time direction. In the comparative example under the condition 17 to 19, rolling was performed similarly to the invention example except that the rolling was accelerated to a steady rolling speed based on the experience of the operator.

Average steady rolling speeds of the steel sheets after 100 coil rolling of the invention example and the comparative example are illustrated in Table 1. As illustrated in Table 1, in the comparative example, because of insufficient learning or execution of the setting of the steady rolling speed based on various experience levels of individual operators, there were cases where the rolling was performed at a low speed without sufficiently utilizing the operational constraint or cases having a trouble such as chattering or breakage occurring beyond the operational constraint.

From the above, it has been confirmed that it is preferable to use the cold rolling method and the cold rolling mill according to aspects of the present invention to appropriately predict the steady rolling speed and the constraint determination value during rolling of the steel sheet and determine the steady rolling speed by appropriately changing the rolling conditions so as to set the predicted constraint determination value to be a preset threshold or less. In addition, it has been confirmed that, by application of aspects of the present invention, it is not only possible to prevent product troubles such as chattering and plate breakage during cold rolling, but also to greatly contribute to improvement in productivity and quality in a rolling step and subsequent steps.

TABLE 1

| No | Amount of Si (mass %) | Finished sheet thickness (mm) | Operator | Dimensionality of explanatory variable | Time pitch (s) of data joined in vertical direction and/or depth direction | Time-series training data | Joining of plurality of coil performances | Average steady rolling speed (mpm) | Steady rolling speed retention time (min.) | Remarks | Remarks |
|---|---|---|---|---|---|---|---|---|---|---|---|
| 1 | 2.5 | 0.30 | | One-dimensional | 0 | | | 1100 | 10 | Occurrence of chattering due to excessive speed | Comparative example |
| 2 | 2.5 | 0.30 | | Two-dimensional | 0 | | | 1024 | 25 | | Invention example |
| 3 | 2.5 | 0.30 | | Three-dimensional | 0 | | | 1015 | 24 | | Invention example |
| 4 | 2.5 | 0.20 | | One-dimensional | 0 | | | 850 | 12 | Occurrence of shape defect | Comparative example |
| 5 | 2.5 | 0.20 | | Two-dimensional | 0 | | | 785 | 28 | | Invention example |
| 6 | 2.5 | 0.20 | | Three-dimensional | 0 | | | 780 | 25 | | Invention example |
| 7 | 2.5 | 0.30 | | One-dimensional | 0 | Present | | 1125 | 12 | Occurrence of edge crack | Comparative example |
| 8 | 2.5 | 0.30 | | Two-dimensional | 0 | Present | | 1050 | 22 | | Invention example |
| 9 | 2.5 | 0.30 | | Three-dimensional | 0 | Present | | 1030 | 21 | | Invention example |
| 10 | 2.5 | 0.30 | | One-dimensional | 0 | | Present | 1110 | 13 | Occurrence of chattering due to excessive speed | Comparative example |
| 11 | 2.5 | 0.30 | | Two-dimensional | 0 | | Present | 1042 | 23 | | Invention example |
| 12 | 2.5 | 0.30 | | Three-dimensional | 0 | | Present | 1010 | 26 | | Invention example |
| 13 | 3.0 | 0.30 | | One-dimensional | 0 | | | 800 | 9 | Occurrence of chattering due to excessive speed | Comparative example |
| 14 | 3.0 | 0.30 | | Two-dimensional | 0 | | | 750 | 18 | | Invention example |
| 15 | 3.0 | 0.30 | | Three-dimensional | 0 | | | 760 | 17 | | Invention example |
| 16 | 2.5 | 0.30 | | Two-dimensional | 1 | | | 1020 | 24 | | Invention example |
| 17 | 2.5 | 0.30 | Operator A | | | | | 1080 | 15 | Occurrence of chattering due to excessive speed | Comparative example |
| 18 | 2.5 | 0.30 | Operator B | | | | | 800 | 23 | Disabled acceleration determination due to shortage of experience | Comparative example |
| 19 | 2.5 | 0.30 | Operator C | | | | | 950 | 18 | Gentle acceleration due to concern about shape defect | Comparative example |

The above has described the embodiments as applications of the invention made by the present inventors, in which the present invention is not limited by the description and drawings constituting a part of the disclosure of the present invention according to the present embodiments. That is, other embodiments, implementation examples, operational techniques, and the like made by those skilled in the art based on the present embodiment are all included in the scope of the present invention.

INDUSTRIAL APPLICABILITY

According to aspects of the present invention, it is possible to provide a cold rolling mill rolling condition calculation method and a cold rolling mill rolling condition calculation device capable of calculating rolling conditions that do not impair productivity while ensuring rolling stability even in the rolling of a difficult-to-roll material with a high load. Further, according to aspects of the present invention, it is possible to provide a cold rolling method and a cold rolling mill capable of stably rolling a difficult-to-roll material with a high load with high productivity. Still further, according to aspects of the present invention, it is possible to provide a steel sheet manufacturing method capable of manufacturing a steel sheet having desired product characteristics and mechanical characteristics with high yield.

REFERENCE SIGNS LIST

1 COLD ROLLING MILL
3 LUBRICATING COOLANT HEADER
4 COOLING COOLANT HEADER
5 DIRTY OIL TANK (RECOVERY TANK)
6 IRON POWDER REMOVER
7 CLEAN OIL TANK (STORAGE TANK)
8 PUMP
9 SUPPLY LINE
10 OIL PAN
11 RETURN PIPE
13 EMULSION ROLLING OIL
14 ROLLING CONTROL DEVICE
15 ARITHMETIC UNIT
71 ARITHMETIC DEVICE
74 PREDICTION MODEL CREATION PROGRAM
75 PREDICTION MODEL EXECUTION PROGRAM
76 ARITHMETIC PROCESSING SECTION
77 PREDICTION MODEL CREATION SECTION
77A TRAINING DATA ACQUISITION SECTION
77B PREPROCESSING SECTION
77C FIRST DATA TRANSFORMER
77D MODEL CREATION SECTION
77E RESULT STORAGE SECTION
78 PREDICTION MODEL EXECUTION SECTION
78A INFORMATION READING SECTION
78B SECOND DATA TRANSFORMER
78C ROLLING SPEED PREDICTING SECTION
78D ROLLING CONDITION DETERMINATION SECTION
78E RESULT OUTPUT SECTION
88 INPUT DEVICE
89 STORAGE DEVICE

90 OUTPUT DEVICE
91 OPERATION MONITORING DEVICE
S STEEL SHEET (ROLLED MATERIAL)

The invention claimed is:

1. A cold rolling mill rolling condition calculation method for a cold rolling mill having at least one rolling stand, the at least one rolling stand having a rolling mill exit side, the method comprising:

estimating a rolling constraint condition with respect to a target steady rolling condition of a roll target material, by inputting second multi-dimensional data to a prediction model, the prediction model having been trained with explanatory variable and response variable, the explanatory variable being first multi-dimensional data generated based on non-steady rolling performance data, among past rolling performance in rolling a roll material by the cold rolling mill, the roll material including a welded portion where a preceding material and a succeeding material are welded to each other, the non-steady rolling performance data being rolling performance data acquired when the welded portion passes through the rolling mill exit side of the at least one rolling stand, and the response variable being steady rolling performance data and rolling constraint condition data during steady rolling, the steady rolling performance data being data indicating a target rolling speed during steady rolling of a roll material rolled in the past, and the second multi-dimensional data having been generated based on non-steady rolling performance data of the roll target material; and changing the target steady rolling condition so that the estimated rolling constraint condition satisfies a predetermined condition.

2. The cold rolling mill rolling condition calculation method according to claim 1, wherein the changing includes changing the target rolling speed during steady rolling of the roll target material so that the estimated rolling constraint condition satisfies a predetermined condition.

3. A cold rolling method comprising rolling a roll target material using a target steady rolling condition changed using the cold rolling mill rolling condition calculation method according to claim 1.

4. A steel sheet manufacturing method comprising:

cold rolling a roll material using the cold rolling method according to claim 1; and applying an annealing treatment at a soaking temperature of 600° C. to 950° C. and a furnace tension of 0.1 to 3.0 $kgf/mm^2$ on the roll material rolled by cold rolling in the cold rolling.

5. A cold rolling mill rolling condition calculation device for a cold rolling mill having at least one rolling stand, the at least one rolling stand having a rolling mill exit side, the device comprising an arithmetic device having an arithmetic processing section configured to:

estimate a rolling constraint condition with respect to a target steady rolling condition of a roll target material, by inputting second multi-dimensional data to a prediction model, the prediction model having been trained with explanatory variable and response variable, the explanatory variable being first multi-dimensional data generated based on non-steady rolling performance data, among past rolling performance in rolling a roll material by the cold rolling mill, the roll material including a welded portion where a preceding material and a succeeding material are welded to each other, the non-steady rolling performance data being rolling performance data acquired when the welded portion passes through the rolling mill exit side of the at least one rolling stand, and the response variable being steady rolling performance data and rolling constraint condition data during steady rolling, the steady rolling performance data being data indicating a target rolling speed during steady rolling of a roll material rolled in the past, and the second multi-dimensional data having been generated based on non-steady rolling performance data of the roll target material; and change the target steady rolling condition so that the estimated rolling constraint condition satisfies a predetermined condition.

6. A cold rolling mill comprising the cold rolling mill rolling condition calculation device according to claim 5.

* * * * *